US005813875A

United States Patent [19]

Ishikawa et al.

[11] Patent Number: 5,813,875

[45] Date of Patent: Sep. 29, 1998

[54] ELECTRICAL CONNECTION BETWEEN STEERING WHEEL AND STEERING COLUMN

[75] Inventors: Satoshi Ishikawa; Hidehiro Ichikawa; Nobuyuki Tsujino; Hiroaki Iizuka, all of Shizuoka-ken, Japan

[73] Assignee: Yazaki Corporation, Tokyo, Japan

[21] Appl. No.: 873,287

[22] Filed: Jun. 11, 1997

Related U.S. Application Data

[63] Continuation of Ser. No. 568,430, Dec. 6, 1995, abandoned.

[30] Foreign Application Priority Data

Dec. 14, 1994 [JP] Japan ..... 6-310646
Jul. 27, 1995 [JP] Japan ..... 7-191763

[51] Int. Cl.[6] ..... H01R 35/04
[52] U.S. Cl. ..... 439/164; 439/15
[58] Field of Search ..... 439/164, 15

[56] References Cited

FOREIGN PATENT DOCUMENTS 591730 4/1994 European Pat. Off. ..... 439/164
60-153490 10/1985 Japan .
2-20791 6/1990 Japan .
4-333473 11/1992 Japan .
4-355085 12/1992 Japan .
5-207632 8/1993 Japan .
6-36040 9/1994 Japan .
7-29658 1/1995 Japan .

*Primary Examiner*—Gary F. Paumen
*Attorney, Agent, or Firm*—Finnegan, Henderson, Farabow, Garrett & Dunner, L.L.P.

[57] ABSTRACT

An electrical connecting device provided between a steering wheel and a steering column to establish an electric connection therebetween. The connecting device comprises a stationary body fixedly secured to the steering column, a rotatable body provided rotatably and placed to define a circular space with respect to the stationary body, a flexible flat cable located in the circular space, one end of which is fixedly secured to the rotatable body and the other end of which is fixedly secured to the stationary body so that the flat cable makes an electrical communication between the rotatable body and the stationary body, and a semi-fluid material adhered to a bottom surface of the stationary body which stands in opposed relation to both ends of the flat cable in its width direction. The flat cable is made to move to follow rotations of the rotatable body in forward or reverse direction. A groove-like pool section is made in the semi-fluid material adhered inner surface in radial direction of the rotatable body. This pool section accommodates the semi-fluid material to satisfy the requirements for improvement of controllability of a steering wheel and suppression of occurrence of noises.

2 Claims, 9 Drawing Sheets

ELECTRICAL CONNECTION BETWEEN STEERING WHEEL AND STEERING COLUMN

This is a continuation of application Ser. No. 08/568,430, filed Dec. 6, 1995, now abandoned.

BACKGROUND OF THE INVENTION

1. Field of the Invention

The present invention relates to a device for establishing an electrical connection between a steering wheel and a steering column of a steering system for motor vehicles.

2. Description of the Prior Art

A recent trend is toward electronic control of motor vehicles, and for the electronic control, various switches are provided even on a steering wheel of a steering system and are connected through electric wires to a steering column side. Since a steering wheel of a motor vehicle is generally designed to be rotatable several times in right- and left-hand directions, for the electrical connection between a rotary shaft of the steering wheel and the steering column it is common that a flexible flat cable (which will be referred hereinafter to as an FFC) including a plurality of lead wires is spirally or return-spirally interposed between a rotatable body fixedly secured to the steering wheel shaft and a stationary body fixedly secured to the steering column side.

A prior electrical connecting device is disclosed in Japanese Utility Model Registration Laid-Open No. 60-153490. As illustrated in a cross-sectional view of FIG. 1 in the publication, this electrical connecting device is equipped with a rotatable body, a housing being a stationary body, an FFC, and a semi-fluid material such as a grease. The FFC constructed spirally is provided between the rotatable body fixedly secured to the steering wheel shaft and the housing fixedly secured to the steering column side.

The rotatable body is composed of a plate-like upper cover section and an inner cylinder provided on a generally middle portion of the upper cover section. The inside portion of the inner cylinder fixedly accommodates a steering shaft (not shown) of the motor vehicle. The housing is composed of a plate-like lower cover section fixedly secured to the steering column (not shown) side and an outer cylinder provided to extend from an outer edge of the lower cover section. The rotatable body and the housing are coaxially combined with each other to be rotatable.

Between the rotatable body and the housing, there is defined a circular (ring-like) space which accommodates the spiral FFC establishing the electrical connection between the steering wheel side and the steering column side. As shown in a plan view of FIG. 1 in the publication, formed in the inner cylinder of the rotatable body is an insertion hole which fixedly accommodates an inner end portion of the FFC. In addition, formed in the outer cylinder of the housing is a through-hole through which the FFC passes and extends to the external. Thus, the FFC can move to follow the rotations of the rotatable body due to the rotations of the steering wheel in a state with maintaining the electrical conduction between the rotatable body and the housing.

As shown in FIG. 1 in the publication, the semi-fluid material adheres to the inner surface of the lower cover section of the housing which stands in opposed relation to a lower end portion of the FFC.

When the steering wheel (not shown) is rotated in one direction (clockwise), the FFC windingly inwardly moves toward the rotatable body side to shrink or tighten.

Meanwhile, in response to the rotation in the opposite direction (counterclockwise), the FFC windingly outwardly moves toward the housing side (its outside) to enlarge or loosen. In either movement, the electrical connection between the rotatable body and the housing remains through the FFC. Further, the semi-fluid material can suppress the generation of noises due to the relative sliding movements between the inner surface of the lower cover section and the lower end portion of the FFC.

Another prior electrical connecting device is disclosed in Japanese Patent Laid-Open No. 4-333473. Referring to FIG. 2 in the publication, this electrical connecting device is provided with a movable body placed in a circular space and having an opening into which an FFC passes. The movable body is provided to be slidably movable on a slide contact surface of a housing, located within the circular space, along the circumferential direction of a rotatable body. Further, a slide sheet is attached onto the outer surface of the movable body. The FFC turns at the opening of the movable body to be wound in the opposite direction. With this arrangement, the FFC can move to follow the rotations of the rotatable body in forward or reverse direction to maintain the electrical conduction between the rotatable body and the housing.

Thus, the provision of the movable body and the reversal winding of the FFC allow the length of the FFC to be shorter as compared with the one-direction winding. In addition, the adhesion of the slide sheet on the movable body can reduce the frictional resistance between the movable body and the slide contact surface and ensure smooth movements of the movable body and the FFC.

However, such a prior art has suffered from an increase in manufacturing cost because the high-slide sheet is relatively expensive. For this reason, it has been proposed that, in place of the slide sheet, a semi-fluid material similar to the semi-fluid material in the FIG. 2 electrical connecting device is placed between the movable body and the slide contact surface. This proposal can suppress the increase in manufacturing cost as well as smooth the movements of the movable body and the FFC.

In a case where the semi-fluid material is employed as in the FIG. 1 in the former publication, electrical connecting device, for maintaining a high controllability of the steering wheel, the semi-fluid material needs to have a relatively low viscosity, thus reducing its own resistance to facilitate the movement of the FFC. On the other hand, in the conventional electrical connecting device, there is a problem associated with the employment of the low-viscosity semi-fluid material in that the semi-fluid material is scraped off from the inner surface of the lower cover section by the FFC at shrinking and enlarging of the FFC to be gradually collected in the inside or outside of the circular space, and hence, a long-time use of the electrical connecting device can lower the noise suppression effects of the semi-fluid material.

Although this problem is avoidable in some degree by increase in the viscosity of the semi-fluid material, the high-viscosity of the semi-fluid material enhances its own resistance to make it difficult to ensure the movement of the FFC and, hence, to increase the rotational torque of the rotatable body, thus lowering the controllability of the steering wheel.

This problem also applies to the electrical connecting device in the latter publication which uses the semi-fluid material in place of the slide sheet as described before. That is, as shown in FIG. 1, since both the movable body 133 and the slide contact surface 137 have a plane configuration, the repeated sliding movements of the movable body 133 sometimes forces the semi-fluid material 109 from between the movable body 133 and the slide contact surface 137 toward the external. Accordingly, this permits the occurrence of noises again between the movable body 133 and the slide contact surface 137 and hinders the smooth movements of the movable body 133 and the FFC with the result that the rotational torque of the rotatable body increases to lower the controllability of the steering wheel.

SUMMARY OF THE INVENTION

It is therefore an object of the present invention to provide an electrical connecting device which is capable of satisfying both the controllability of the steering wheel and the noise suppression.

In accordance with the present invention, an electrical connecting device provided between a steering wheel and a steering column to establish an electric connection therebetween, comprising a stationary body fixedly secured to the steering column, a rotatable body rotatable and placed to form a circular space with respect to the stationary body, a flexible flat cable inserted into the circular space, one end of which is fixedly secured to the rotatable body and the other end of which is fixedly secured to the stationary body so that the flat cable makes an electrical communication between the rotatable body and the stationary body, and a semi-fluid material adhered to an inner surface of at least one of the stationary body and the rotatable body which stands in opposed relation to both ends of the flat cable in its width direction, the flat cable moving to follow rotations of the rotatable body in opposite directions, wherein a groove-like pool section is made in the semi-fluid material adhered inner surface in a radial direction of the rotatable body to accommodate the semi-fluid material.

Since the groove-like pool section is made in the semi-fluid material adhered inner surface in a radial direction of the rotatable body, even if the semi-fluid material is scraped off from the inner surface at the time of the shrinking and enlarging of the flat cable, the semi-fluid material is immediately held within the pool section and then gradually supplied to the inner surface. More specifically, limitation is imposed on the radial movement of the semi-fluid material, and hence, even if having a relatively low viscosity, the semi-fluid material remains to be wholly adhered onto the inner surface without being scraped and collected in the inside or outside of the circular space. In addition, since the pool section is formed in a radial direction, the flat cable can smoothly move in a circumferential direction of the rotatable body because its end portions are not caught on the pool section.

Furthermore, in an aspect of the present invention, a plurality of groove-like pool sections are made equiangularly. Thus, the formation of the plurality of pool sections can control the radial even movements of the semi-fluid material toward the whole inner surface.

In another preferred form of this invention, the groove-like pool section is a linear one.

In a further preferred form of this invention, the groove-like pool section is a wave-formed one.

In a further preferred form of this invention, the groove-like pool section has guitar-shaped portions continuously arranged.

In a further preferred form of this invention, an electrical connecting device provided between a steering wheel and a steering column to establish an electric connection therebetween, comprising a stationary body fixedly secured to the steering column, a rotatable body rotatable and placed to form a circular space with respect to the stationary body, a flexible flat cable inserted into the circular space, one end of which is fixedly secured to the rotatable body and the other end of which is fixedly secured to the stationary body so that the flat cable builds up an electrical communication between the rotatable body and the stationary body, and a movable body placed in the circular space and having an insertion section through which the flat cable passes, the movable body being slidable on a slide contact surface within the circular space along a rotational direction of the rotatable body and the flat cable reversely turning halfway at the insertion section of the movable body so that its winding direction in an inside of the movable body is opposite to that in an outside thereof, and moving to follow rotations of the rotatable body in forward or reverse direction, wherein at least one of the slide contact surface within the circular space and a sliding surface of the movable body coming into contact with the slide contact surface has a groove section which allows reduction of a sliding resistance to the movable body.

Thus, the formation of the groove section in at least one of the slide contact surface and the sliding surface for the reduction of the sliding resistance to the movable body can ensure the smooth sliding movements of the movable body and reduce the load on the flat cable without complicating its construction and greatly increasing its manufacturing cost.

In a further preferred form of this invention, a semi-fluid material is adhered to between the slide contact surface within the circular space and the sliding surface of the movable body, and the groove section accommodates the semi-fluid material. Accordingly, although being employed in order to ensure the smoother sliding motion of the movable body, the semi-fluid material is not extruded toward the external but held in the groove section to exist between the slide contact surface and the sliding surface even if the movable body slides repeatedly. This can reduce the load on the flat cable in addition to ensuring the smooth movements of the movable body irrespective of use for a long time.

In a further preferred form of this invention, the aforesaid groove section is formed along a circumferential direction of the rotatable body. This formation of the groove section along the circumferential direction can surely promise the effective reduction of the sliding resistance to the movable body and the further reduction of the load on the flat cable.

In a still further preferred form of this invention, the aforementioned groove section is substantially formed over the whole of at least one of the side contact surface and the sliding surface. In a case where the semi-fluid material is attached to between the slide contact surface and the sliding surface, the formation of the groove section over the substantially entire surface can wholly build up the resistance to the movements toward the external and unify the adhered semi-fluid material over the generally whole contact area therebetween. Whereupon, the movable body can slide more smoothly and the load on the flat cable can further decrease.

In a still further preferred form of this invention, aforementioned groove section is divided with regard to the circumferential direction into a plurality of short parts. Therefore, the reduction of the length of the groove sections allows the movements of the semi-fluid material in the circumferential directions to be suppressible and makes the adhesion thereof more uniformly maintainable.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
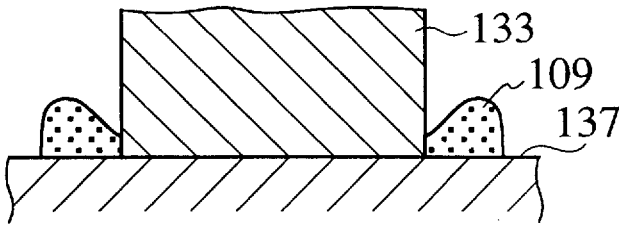
FIG. 1 PRIOR ART
FIG. 1 is a cross-sectional view useful for describing a problem of the prior art.
Figure 2:
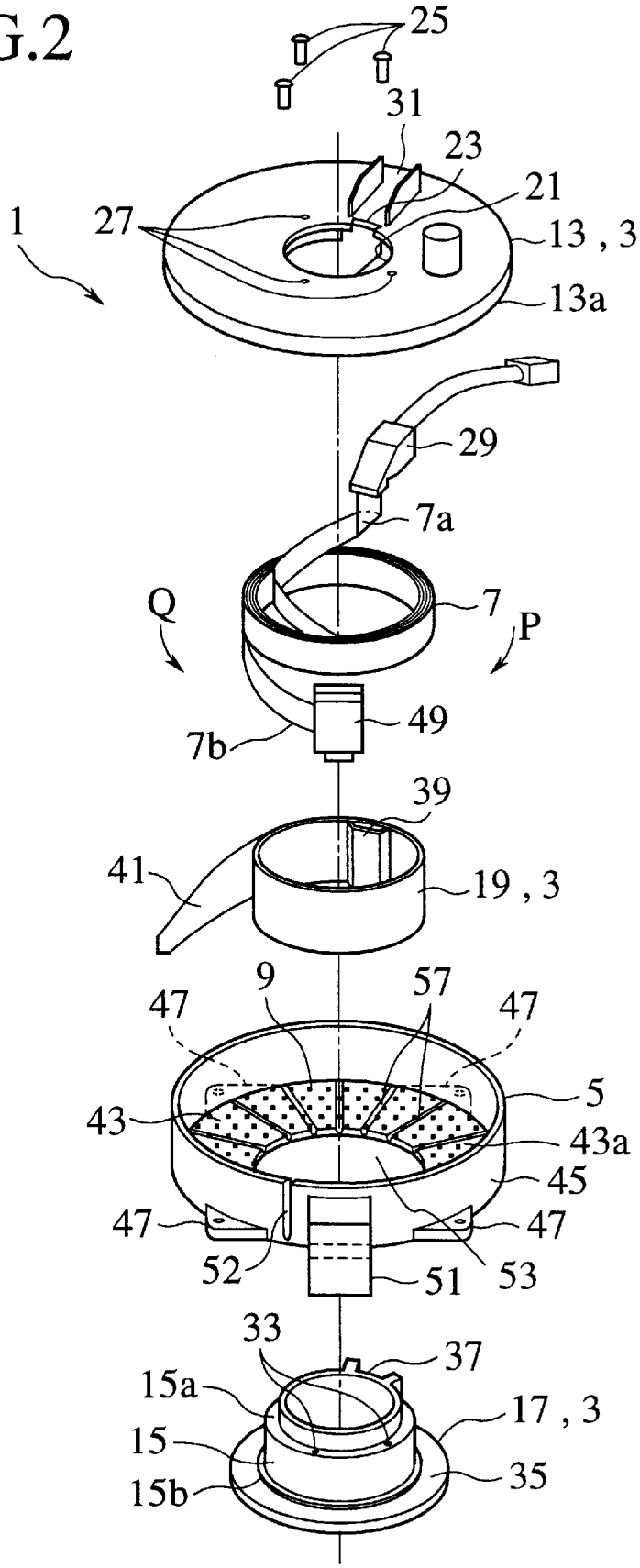
FIG. 2 is an exploded, perspective view showing an electrical connecting device according to a first embodiment of the present invention.
Figure 3:
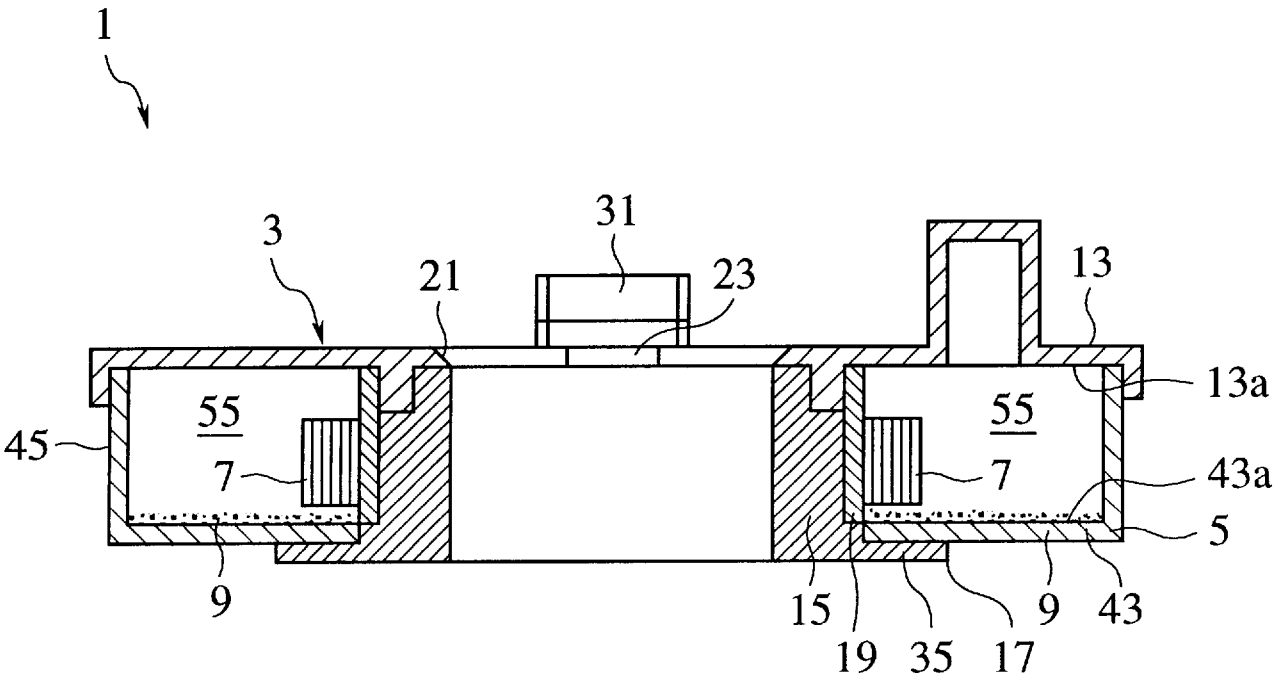
FIG. 3 is a side elevational, cross-sectional view showing an assembled state of the electrical connecting device of FIG. 2.
Figure 4:
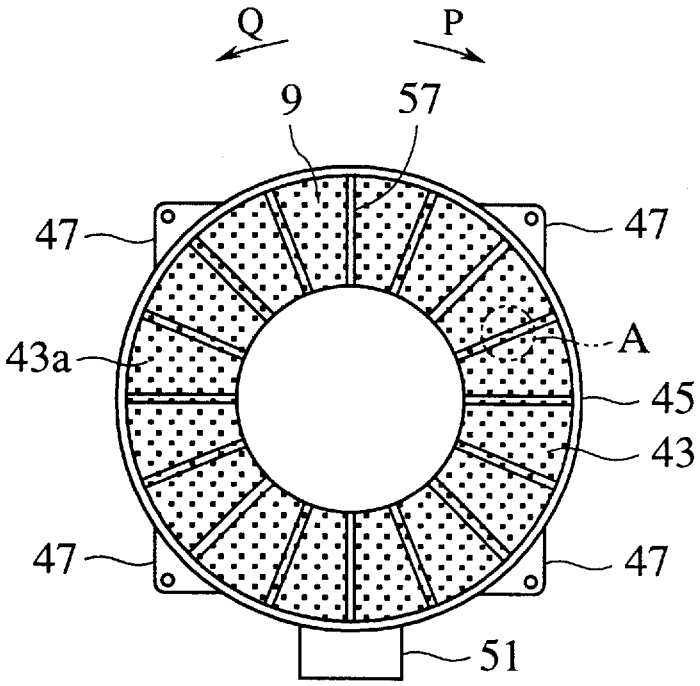
FIG. 4 is a plan view showing a housing of the electrical connecting device of FIG. 2.
Figure 5:
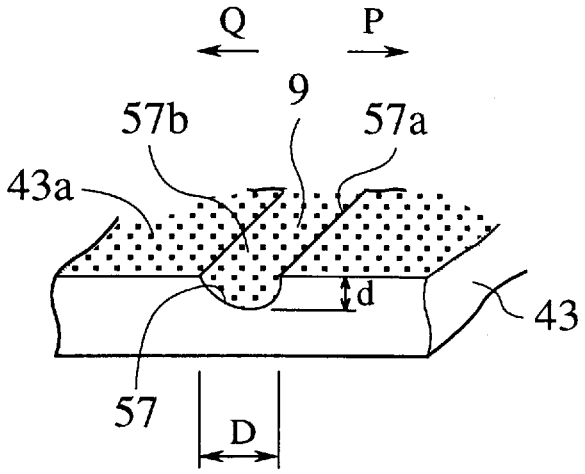
FIG. 5 is an enlarged, perspective view of a portion indicated at reference character A in FIG. 4.

A description will be made hereinbelow of a first embodiment of this invention with reference to the exploded perspective view of FIG. 2 showing an electrical connecting device according to this embodiment, the assembled view of FIG. 3 showing the assembled state of the connecting device, the plan view of FIG. 4 showing a housing of the connecting device, and the enlarged perspective view FIG. 5 showing a A portion in FIG. 4.

This electrical connecting device, designated at reference numeral 1, comprises a rotatable body 3, a housing 5 serving as a stationary body, a flexible flat cable (FFC) 7 for establishing an electrical connection between a steering wheel and a steering column side, and a semi-fluid material 9. The FFC 7 is spirally located in between the rotatable body 3 and the housing 5. The rotatable body 3 is composed of a doughnut-like (EP record-like) upper cover 13, a rotator 17 having an inner cylinder 15 being of a generally cylindrical configuration, and a generally cylindrical end supporting member 19 fitted over the inner cylinder 15 of the rotator 17. In a circumferential surface of a central hole 21 of the upper cover 13 there is made a recessed portion (notched portion) 23 through which one end 7*a* of the FFC 7 passes, and around the central hole 21 there are made three bolt insertion holes 27 for three detachable bolts 25 and a connector supporting section 31 for supporting a connector 29 attached to the one end 7*a* of the FFC 7.

A steering shaft (not shown) of a motor vehicle is inserted into the inner cylinder 15 of the rotator 17 so that the rotator 17 is fixed to the steering shaft. One end surface 15*a* of the inner cylinder 15 of the rotator 17 has boltholes 33 to be engaged with the detachable bolts 25. A flange section 35 is protrusively formed on an outer circumferential surface near the other end surface 15*b* of the inner cylinder 15. Further, a projection 39 is provided on the outer circumferential surface of the inner cylinder 15, while a dent 37 is provided on the inner circumferential surface of the end supporting member 19, both 39, 37 being engageable with each other. A tongue-like portion 41 is protrusively formed on the outer circumferential surface of the end supporting member 19.

The housing 5 is composed of a disc-like lower cover 43 and an outer cylinder 45 provided on an outer edge of the disc-like lower cover 43 to extend at a substantially right angle therefrom. On the outer circumferential surface of the outer cylinder 45, there are protrusively formed four fixed flange portions 47 fixedly secured to the steering column (not shown) side and a connector supporting section 51 for supporting a connector 49 attached to the other end 7*b* of the FFC 7. Further, made in the outer cylinder 45 is a slit 52 into the other end 7*b* of the FFC 7 passes, and formed in the generally central portion of the lower cover 43 is a central hole 53 into which the inner cylinder 15 of the rotator 17 is inserted to be rotatable. The inner cylinder 15 of the rotator 17 is inserted from its one end 15*a* side into the central hole 53 of the housing 5, and the end supporting member 19 is fitted over the inner cylinder 15 in a state that the projection 39 and the dent 37 are aligned with each other, before the upper cover 13 is put thereon and the upper cover 13 is fixed to the rotator 17 through the detachable bolts 25. With this construction, the housing 5 is rendered to be rotatable forward and reversibly between the upper cover 13 and the flange section 35 of the rotator 17. In addition, the rotatable body 3 can be combined with the housing 5 to be rotatable relative thereto and as shown in FIG. 3 a circular (ring-like) space 55 is defined between the rotatable body 3 and the housing 5. At the building-in of the rotatable body 3, the FFC 7 is configured spirally and set within the circular space 55. At setting the FFC 7, as shown in FIG. 2, the one end 7*a* of the FFC 7 is put through the recessed portion 23 of the upper cover 13, while the other end 7*b* of the FFC 7 is passed through a hole (not shown) of the outer cylinder housing 45 in a state that the connector 29 attached to the one end 7*a* thereof is supported by the connector supporting section 31 of the upper cover 13. The connector 49 attached to the other end 7*b* thereof is supported by another connector supporting section 51.

The semi-fluid material 9 is a grease or the like and is adhered to a bottom surface, i.e., an inner surface, 43*a* of the lower cover 43 of the housing 5 which is in opposed relation to a lower end of the FFC 7. In the bottom surface 43*a*, at least one linear groove-like pool section (plural pool sections in the illustration) 57 accommodating the semi-fluid material 9 are formed in radial directions of the rotatable body 3. For example, as shown in FIG. 4, 16 pool sections 57 are substantially equiangularly made to extend radially from the central hole 53. Further, as shown in FIG. 5, each pool section 57 has an arc cross section and comprises two portions: an inner wall 57*a* positioned ahead in one rotating direction (a direction indicated by an arrow P) of the rotatable body 3 and an inner wall 57*b* positioned ahead in the reverse direction (a direction indicated by an arrow Q). The pool section 57 is set to have a width D of approximately 2 to 3 mm and a depth of approximately 0.5 to 1 mm. Incidentally, although in this embodiment the semi-fluid material 9 is adhered to the bottom surface 43*a* of the lower cover 43 and the pool sections 57 are made in the bottom surface 43*a*, it is also possible that the semi-fluid material 9 is adhered to an inner surface 13*a* of the upper cover 13 which bears opposed relation to the upper end of the FFC 7 and pool sections (not shown) are made in the same inner surface 13*a*.

The electrical connecting device 1 assembled is attached to the motor vehicle body in such a way that the inner cylinder 15 of the rotator 17 is fitted over a steering shaft (not shown) of the vehicle and the fixed flange section 47 of the housing 5 is fixedly secured to a steering column (not shown) thereof. In this state, when a steering wheel (not shown) is rotated in one direction (clockwise), the rotatable body 3 also rotates in the same direction (direction indicated by the arrow P) so that the FFC 7 inwardly windingly shrinks toward the end supporting member 19. On the other hand, when the steering wheel is rotated in the reverse direction (counterclockwise), the rotatable body 3 also rotates in the same direction (direction indicated by the arrow Q) so that the FFC 7 outwardly windingly enlarges to separate from the end supporting member 19 and thereafter reversely shrinks toward the end supporting member 19. Thus, the FFC 7 moves to follow the rotations of the rotatable body 3 due to the rotations of the steering wheel in the one- and reverse-directions, whereby the electrical connection between the rotatable body 3 and the housing 5 can always be maintained through the FFC 7. In this instance, the FFC 7 is pressed against the tongue-like portion 41 of the end supporting member 19 when reaching the winding limitation at the aforesaid reverse-direction rotation, with the result that the tongue-like portion 41 is protective toward the FFC 7.

Since in the electrical connecting device 1 thus constructed, as described above, the groove-like pool sections 57 are made in the bottom surface 43*a* of the lower cover 43 with the adhered semi-fluid material 9 so as to extend in the radial directions of the rotatable body 3, even if the semi-fluid material 9 is scraped off from the bottom surface 43*a* at the time of the shrinkage and enlargement of the FFC 7, the semi-fluid material 9 is put in the pool sections 57 adjacent thereto. For example, the semi-fluid material 9 scraped off strikes against the inner wall 57*a* positioned ahead in the one rotating direction (direction indicated by the arrow P) when the rotatable body 3 rotates in the one direction, and is put in the pool sections 57. Going the other way, it strikes against the inner wall 57*b* positioned ahead in the reverse rotating direction (direction indicated by the arrow Q) and are put in the pool sections 57. The semi-fluid material 9 within the pool sections 57 again gradually leaves for the bottom surface 43*a* as the semi-fluid material 9 on the bottom surface 43*a* decreases in quantity.

That is, the semi-fluid material 9 is allowed to move in the rotating direction but being controlled to move in the radial directions while the FFC 7 tightens and loosens, and hence the collection of the scraped semi-fluid material 9 in the inside or outside of the circular space 55 is avoidable with no increase in the resistance to the FFC 7. For this reason, even if the semi-fluid material 9 has a low viscosity, the semi-fluid material 9 is satisfactorily adhered onto the whole bottom surface 43*a* and maintained as it is. Accordingly, regardless of long use of the electrical connecting device 1, the excellent adhesion of the semi-fluid material 9 over the whole bottom surface 43*a* is maintainable without building up the resistance to the FFC 7, and the controllability of the steering wheel and the suppression of the noise due to the sliding of the FFC 7 relative to the bottom surface 43*a* are compatible with each other.

Furthermore, since the pool sections 57 are made so as to extend in directions crossing the rotating directions (directions indicated by the arrows P, Q), i.e., in the radial directions, the lower and upper ends of the FFC 7 are not caught on the pool sections 57, with the result that the smooth movement of the FFC 7 is maintainable. Moreover, since the plurality of pool sections 57 are equiangularly provided to radially extend with respect to the rough axis of rotation of the rotatable body 3, the radial-direction movements of the semi-fluid material 9 is evenly controllable in the whole bottom surface 43*a*. That is why the substantially uniform adhesion of the semi-fluid material 9 is maintainable over the entire bottom surface 43*a*, and further the controllability of the steering wheel and the noise suppression can effectively improve.

Figure 6:
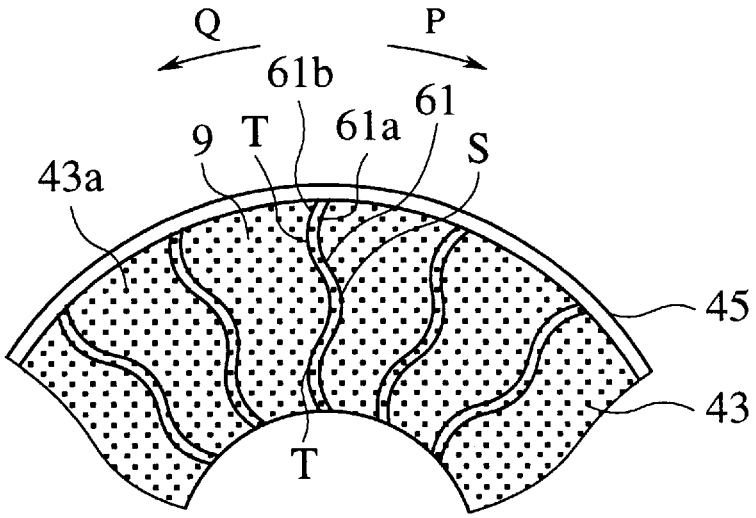
FIG. 6 is a plan view showing a housing according to a second embodiment of this invention.

Secondly, a description will be taken hereinbelow of a second embodiment of this invention in conjunction with FIG. 6 being a plan view of a portion of a housing. In FIG. 6, parts corresponding to those in the abovedescribed first embodiment are marked with the same reference numerals. The feature of the second embodiment is that as shown in FIG. 6 a plurality of corrugated, groove-like pool sections 61 having convex (protrusive) portions S, T in its both inner walls 61*a*, 61*b* are radially made in place of the linear pool sections 57 in the first embodiment. These convex portions S, T are formed in the inner wall 61*a* positioned ahead in the one rotating direction (direction indicated by an arrow P) of the rotatable body 3 (see FIG. 2) and in the inner wall 61*b* positioned ahead in the reverse rotating direction (direction indicated by an arrow Q) to be curved toward the outside of the grooves. In the inner walls 61*a*, 61*b*, a portion which is in opposed relation to each of the convex portions S, T is curved (concaved) toward the inside of the groove in conformity with its convex configuration. Although in this embodiment the convex portions S, T are formed curvedly, it is also appropriate that they are made linearly.

According to this second embodiment, since the convex portions S, T curved toward the outside of the groove are constructed in the inner walls 61*a*, 61*b* of the pool section 61, in addition to the effects of the aforementioned first embodiment, it is further possible to provides an effect that the semi-fluid material 9 accommodated in the pool sections 61 becomes easy to stay owing to the convex portions S, T. For example, when the rotatable body 3 (see FIG. 2) is rotating in the one direction, the FFC 7 (see FIG. 2) moves in the one direction (direction indicated by the arrow P) so that the semi-fluid material 9 becomes easy to remain on the convex portion S of the inner wall 61*a* located ahead in the one direction. On the other hand, when it is rotating in the reverse direction, the FFC 7 moves in the reverse rotating direction (direction indicated by the arrow Q) so that the semi-fluid material 9 becomes easy to stay on the convex portion T of the inner wall 61*b* located ahead in the reverse rotating direction. Whereupon, the radial movements of the semi-fluid material 9 within the pool sections 61 is certainly controllable at the shrinkage and enlargement of the FFC 7, and the intensive collection of the semi-fluid material 9 into the inside or outside of the circular space 55 (see FIG. 3) is more suppressible.

Figure 7:
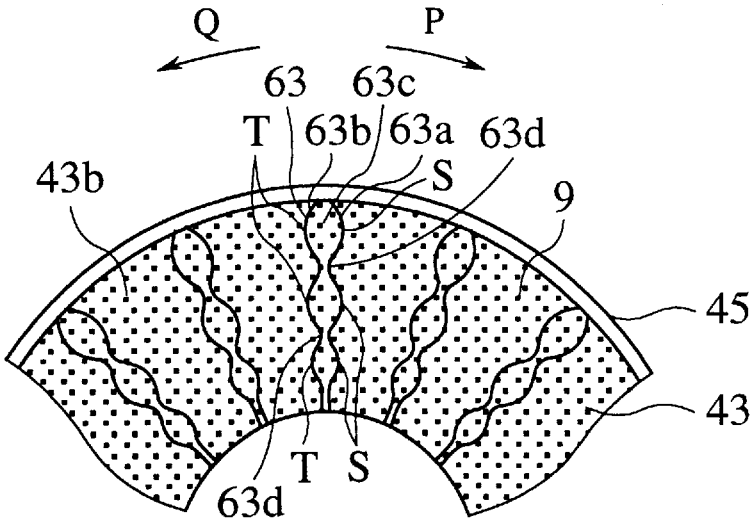
FIG. 7 is a plan view showing a housing according to a third embodiment of this invention.

Furthermore, a description will be made hereinbelow of a third embodiment of this invention with reference to FIG. 7 being a plan view of a portion of a housing. In FIG. 7, parts corresponding to those in the abovementioned first embodiment are marked with the same reference numerals. Although in this embodiment convex portions S, T are provided as well as in the second embodiment, the difference is that the convex portions S, T are symmetrically made in both inner walls 63*a*, 63*b* of each of pool sections 63 to have opposed relation to each other. More specifically, each of the pool sections 63 has guitar-shaped portions continuously arranged, and the width of the pool sections 63 becomes large at positions 63*c* between the convex portions S, T while becoming small at end portions 63*d* of the guitar configuration.

This third embodiment, in addition to the effects of the second embodiment, can produce the effect that the semi-fluid material 9 becomes easy to stay in the wider portions 63*c* between the convex portions S, T at the shrinkage and enlargement of the FFC 7, and further create the effect that the radial movements of the semi-fluid material 9 is certainly controllable due to the narrower end portions 63*d*. Accordingly, the intensive collection of the semi-fluid material 9 into the inside or outside of the circular space 55 (see FIG. 3) becomes surely suppressible.

Although the first to third embodiments relates to the electrical connecting device 1 which is of a so-called spiral type in which the FFC 7 is used in a spirally configured condition, the structural features of these embodiments are applicable to electrical connecting device which is of a so-called inversion (turning) type where the FFC 7 is wound to reversely turns halfway. That is, even in the inversion type electrical connecting device, if the pool sections 57, 61 and 63 are provided in the inner surface to which the semi-fluid material adheres, the same effects will take place.

Figure 8:
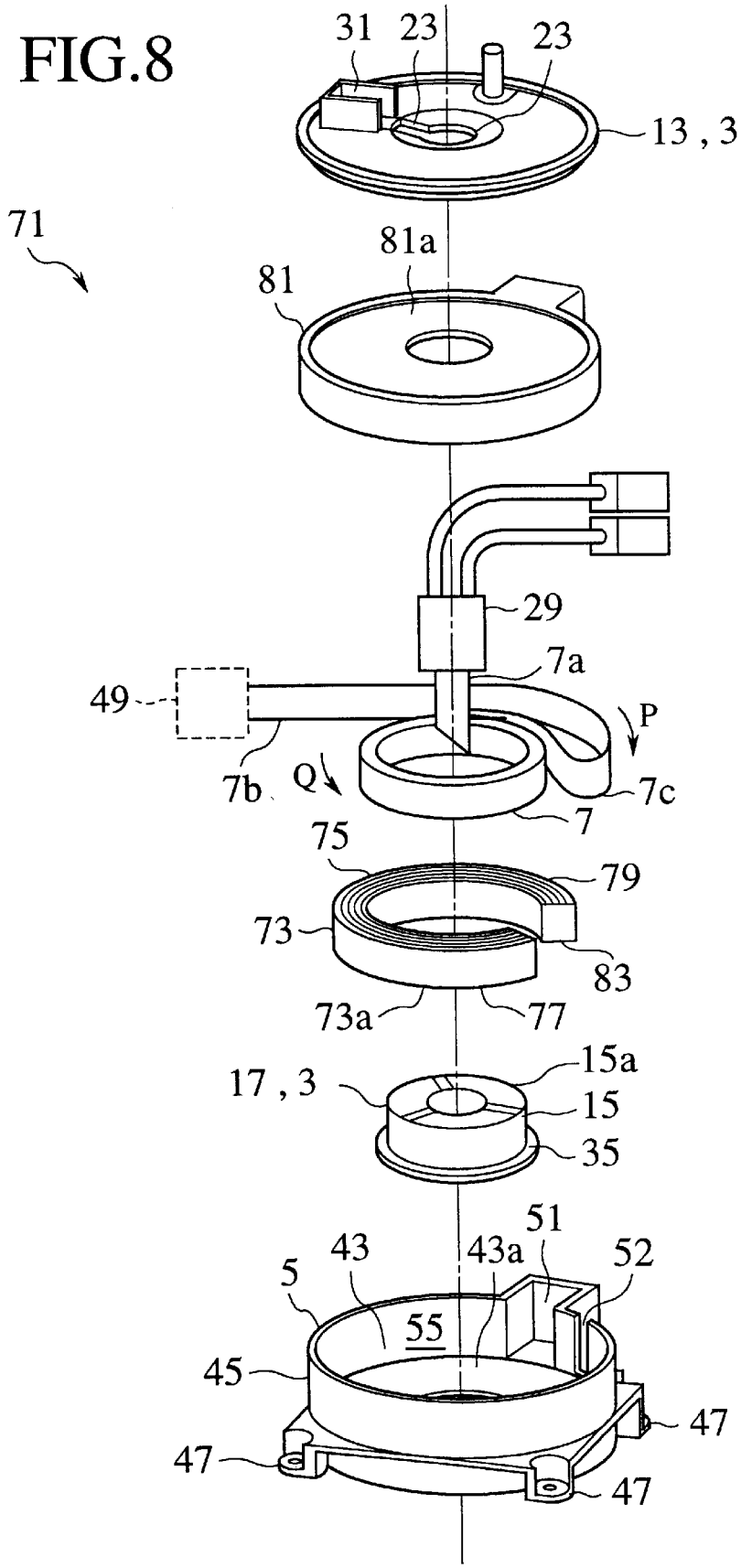
FIG. 8 is an exploded, perspective view showing an electrical connecting device according to a fourth embodiment of the present invention.
Figure 9:
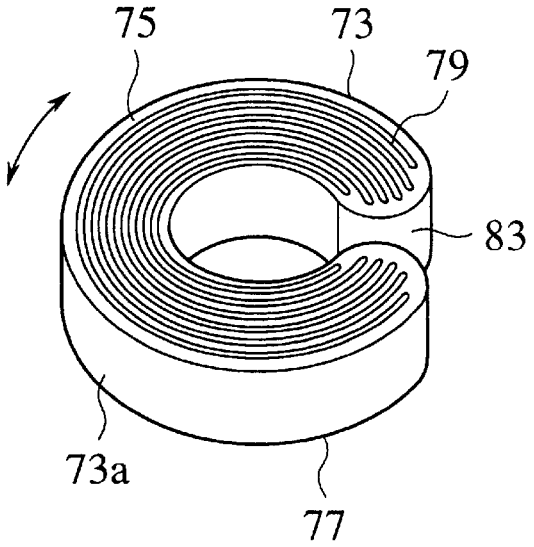
FIG. 9 is a perspective view showing a carrier in FIG. 8.
Figure 10A:
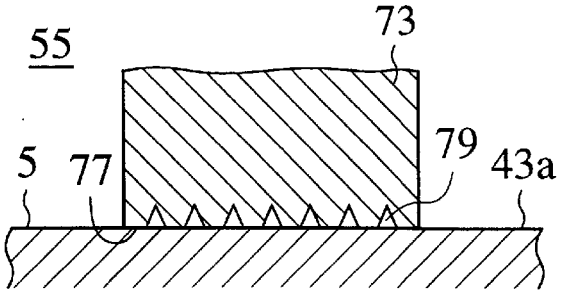
FIG. 10A is a cross-sectional view showing an inner surface of a housing and a lower surface of the carrier in FIG. 8, illustrating a state in which no semi-fluid material is adhered thereto.
Figure 10B:
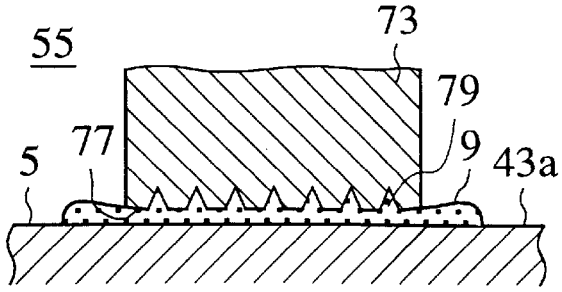
FIG. 10B is a cross-sectional view showing the inner surface of the housing and the lower surface of the carrier in FIG. 8, illustrating a semi-fluid material adhered state.

Moreover, a description will be made hereinbelow of a fourth embodiment of this invention with reference to FIGS. 8, 9, 10A and 10B. FIG. 8 is an exploded perspective view of an electrical connecting device according to the fourth embodiment of this invention, FIG. 9 is a perspective view showing a carrier of the FIG. 8 electrical connecting device, FIG. 10A is a cross-sectional view showing an inner surface of a housing and a lower surface of the carrier wherein a semi-fluid material does not adhere thereto, and FIG. 10B is a cross-sectional view showing the same inner surface of the housing and the same lower surface of the carrier wherein a semi-fluid material adheres thereto. In these figures, parts corresponding to those in the first embodiment are marked with the same reference numerals.

As shown in FIG. 8, an electrical connecting device 71 according to this embodiment has, within a circular space 55 of a housing 5, a carrier 73 serving as a movable body for accommodating an FFC 7 in a state that the FFC 77 reversely turns halfway, and further groove sections 79 are made in upper and lower surfaces 75, 77 of the carrier 73 acting as sliding surfaces. Onto the housing 5 there is attached a housing cover 81 for covering the upper side (upper cover 13 side) of the circular space 55. Further, an upper cover 13 is rotatably placed on an upper surface 81*a* of the housing cover 81. The carrier 73 is formed to have a generally C-like plan configuration with an opening 83 serving as an insertion portion and is set rotatably with respect to a rotator 17 and the housing 5. The carrier 73 rotates along the rotating direction of a rotatable body 3 around an inner cylinder 15 of the rotator 17. The FFC 7 is wound from its one end 7*a* side around the inner cylinder 15 of the rotator 17, before being inserted into the opening 83 at its a turning portion 7*c* and further wound reversely along an outer circumferential surface 73*a* of the carrier 73 so that the winding directions of the FFC 7 in the inside and outside of the carrier 73 are different from (opposite to) each other. When the upper cover 13 rotates in one direction (direction indicated by an arrow P), the turning portion 7*c* of the FFC 7 moves by a distance smaller than the rotating amount of the upper cover 13 in the same direction (direction indicated by the arrow P), and the FFC 7 is supplied by a length equal to the moved distance of the turning portion 7*c* through the opening 83 so that the advanced portion of the FFC 7 is wound around the outer circumferential surface 73*a* of the carrier 73. On the contrary, when the upper cover 13 rotates in the reverse direction (direction indicated by an arrow Q), the turning portion 7*c* of the FFC 7 moves by a distance smaller than the rotated amount of the upper cover 13 in the same direction (direction indicated by the arrow Q) and the FFC 7 is rewound by a length equal to the moved amount of turning portion 7*c* toward the rotator 17 side and wound around the inner cylinder 15 of the rotator 17. In accordance with the supply and rewind of the FFC 7, the carrier 73 rotates to allow the movement of the turning portion 7*c*. The upper and lower surfaces 75, 77 of the carrier 73 stand in opposed relation to the bottom surface 43*a* of the housing 5 and a lower surface (not shown) of the housing cover 81 serving as a slide contact surface, and the facing surfaces relatively slidingly move when the carrier 73 rotates.

The aforesaid plurality of groove sections 79, as shown in FIG. 10A, can reduce the contact areas with the upper and lower surfaces 75, 77 of the carrier 73, the lower surface (not shown) of the housing cover 81 and the bottom surface 43*a* of the housing 5 so as to decrease the sliding resistances to the mating surfaces. As shown in FIG. 9, the groove sections 79 are made in the substantial whole of the upper and lower surfaces 75, 77 of the carrier 73 along the circumferential direction of the carrier 73 (the rotating direction of the rotatable body 3) to bear generally C-like arc configurations arranged successively in the width directions of the upper and lower surfaces 75, 77 of the carrier 73. The upper surface 75 side groove sections are omitted from the illustration.

According to the fourth embodiment, since the groove sections 79 are provided in the upper and lower surfaces 75, 77 of the carrier 73 in order to reduce the sliding resistances to the carrier 73, the smooth sliding movements of the carrier 73 can be ensured with a simple and cheap construction. Accordingly, not only the load on the FFC 7 due to the carrier 73 is reducible but also the enhancement of the rotational torque of the rotatable body 3 is suppressible, and even the controllability of the steering wheel and the noise suppression are compatible with each other.

In addition, since the groove sections 79 are formed along the circumferential direction (rotating direction) of the carrier 73, the sliding resistance to the carrier 73 is effectively reducible and the load on the FFC 7 is further reducible, and the improvement of the controllability of the steering wheel and the noise suppression effect are more effectively achievable.

Moreover, if, for smoother movement of the carrier, as shown in FIG. 10B, a semi-fluid material 9 similar to that in the first embodiment is adhered onto the upper and lower surfaces 75, 77 of the carrier 73, the lower surface of the housing cover 81 and the bottom surface 43*a* of the housing 5, even though the carrier 73 repeatedly slides, the semi-fluid material 9 is accommodated in the groove sections 79 without being extruded to the external, thus remaining between the carrier 73 and the housing cover 81 or the housing 5. That is why the smooth movements of the carrier 73 due to the semi-fluid material 9 is maintainable regardless of long use and the load on the FFC 7 is reducible, besides the improvement of the controllability of the steering wheel and the noise suppression effect are more effectively achievable.

Still further, since the groove sections 79 are provided over substantially whole areas of the upper and lower surfaces 75, 77 of the carrier 73, the movements of the semi-fluid material 9 toward the external is controllable over the substantially whole contact area between the carrier 73 and the housing cover 81 or the housing 5 and the substantially uniform adhesion of the semi-fluid material 9 thereto is maintainable. For these reasons, the smoother sliding movements of the carrier 73 is possible and the load on the FFC 7 is reducible, and more-over, the improvement of the controllability of the steering wheel and the noise suppression effect are more effectively achievable.

Figure 11:
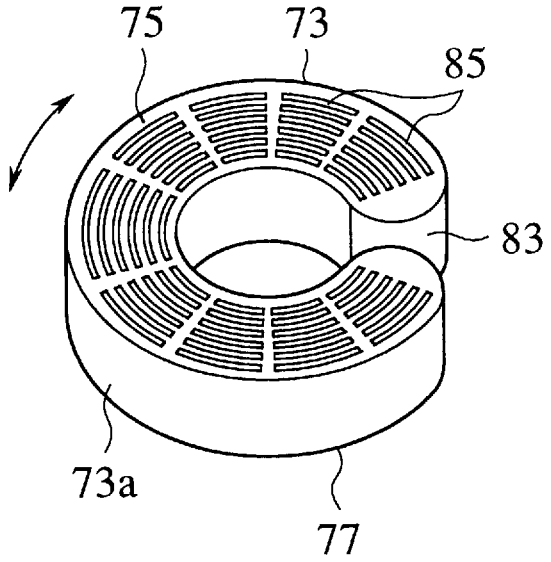
FIG. 11 is a perspective view showing a modification of the FIG. 8 carrier.

FIG. 11 is a perspective view of a modification of the carrier shown in FIG. 8. In this modification, each of the groove sections 79 shown in FIG. 8 is divided into a plurality of short parts 85. The reduction of the length of the groove sections allows the movements of the semi-fluid material in the circumferential directions to be suppressible and makes the adhesion thereof more uniformly maintainable.

Figure 12:
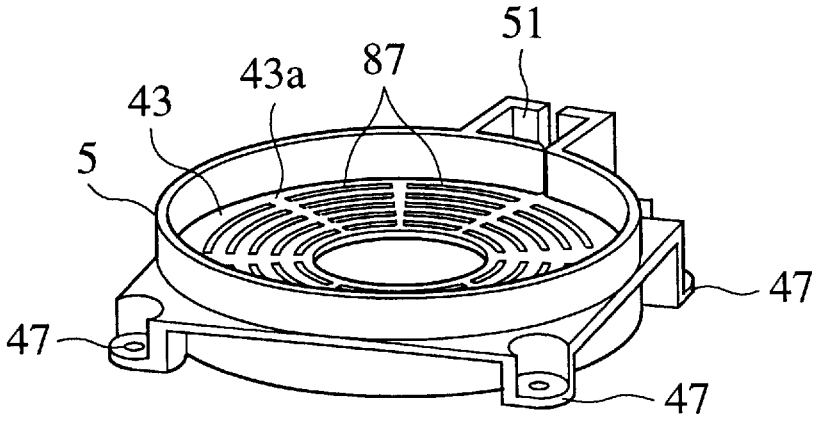
FIG. 12 is a perspective view showing a housing of the electrical connecting device according to a fifth embodiment of this invention.
Figure 13A:
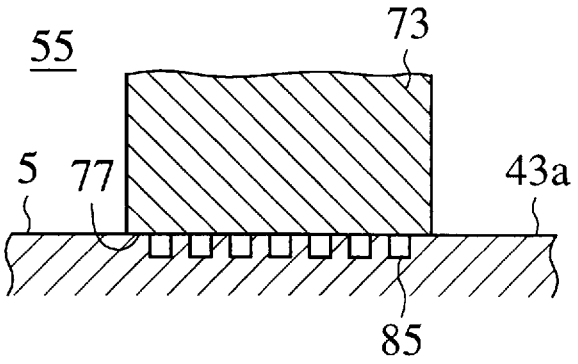
FIG. 13A is a cross-sectional view showing the inner surface of the housing and a bottom surface of the carrier in FIG. 8, illustrating a state in which no semi-fluid material is adhered thereto.
Figure 13B:
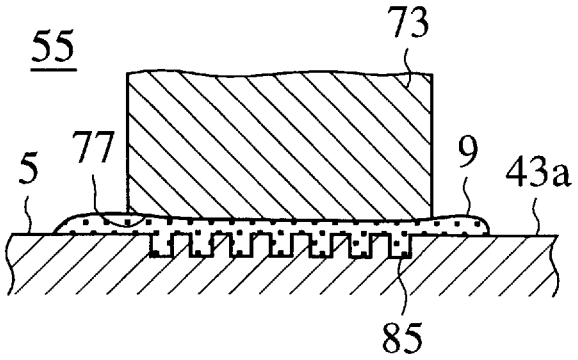
FIG. 13B is a cross-sectional view showing the inner surface of the housing and the bottom surface of the carrier in FIG. 8, illustrating a semi-fluid material adhered state.

Moreover, a description will be made hereinbelow of a fifth embodiment of this invention. FIG. 12 is a perspective view showing a housing of an electrical connecting device according to the fifth embodiment, FIG. 13A is a cross-sectional view showing an inner surface of the FIG. 12 housing and a lower surface of a carrier, illustrating a state that no semi-fluid material is adhered thereto, and FIG. 13B is a cross-sectional view showing the same inner surface and same lower surface, illustrating a semi-fluid material adhered condition.

The feature of this fifth embodiment is that, in place of the groove sections 73 in the upper and lower surfaces 75, 77 of the carrier 73 in the fourth embodiment, as shown in FIG. 12 a plurality of groove sections 87 having the substantially same configurations as those of the groove sections 85 in FIG. 11 are provided in a lower surface (not shown) of a housing cover 81 and a bottom surface 43*a* of a housing 5. According to the fifth embodiment, the same effects as those of the fourth embodiment is obtainable. More specifically, since as shown in FIG. 13A the groove sections 87 are provided in the lower surface (not shown) of the housing cover 81 and the bottom surface 43*a* of the housing 5 along the circumferential directions of the carrier 73 to reduce the contact area to lessen the sliding resistance to the carrier 73, the smooth movements of the carrier 73 is possible with a simple and cheap construction. Further, if as shown in FIG. 13B the semi-fluid material 9 is adhered thereto, the groove sections 85 accommodates the semi-fluid material 9, thus maintaining the smooth sliding movements of the carrier 73 due to the semi-fluid material 9.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An electrical connecting device provided between a steering wheel and a steering column to establish an electric connection therebetween, comprising:

a stationary body fixedly secured to the steering column;

a rotatable body positioned to define a circular space with respect to said stationary body;

a flexible flat cable located in said circular space, one end of said flexible flat cable being fixedly secured to said rotatable body and the other end thereof being fixedly secured to said stationary body so that said flat cable provides an electrical communication between said rotatable body and said stationary body; and a movable body placed in said circular space and having an insertion section through which said flat cable passes, said movable body having a sliding surface slidable on a slide contact surface within said circular space and extending in a rotational direction of said rotatable body, and said flat cable reversely turning halfway at said insertion section of said movable body so that its winding direction inside of said movably body is opposite to that outside thereof and movable to follow rotation of said rotatable body relative to the stationary body in forward and reverse directions, wherein at least one of said slide contact surface within said circular space and the sliding surface of said movable body coming into contact with said slide contact surface, has a groove section having alternating grooves and flat portions extending in a circumferential direction to reduce sliding resistance to said movable body, said groove section being formed substantially over the whole of at least one of said slide contact surface and said sliding surface, and being divided circumferentially into a plurality of segments.

2. An electrical connecting device provided between a steering wheel and a steering column to establish an electric connection therebetween, comprising:

a stationary body fixedly secured to the steering column;

a rotatable body positioned to define a circular space with respect to said stationary body;

a flexible flat cable located in said circular space, one end of said flexible flat cable being fixedly secured to said rotatable body and the other end thereof being fixedly secured to said stationary body so that said flat cable provides an electrical communication between said rotatable body and said stationary body; and a movable body placed in said circular space and having an insertion section through which said flat cable passes, said movable body having a sliding surface slidable on a slide contact surface within said circular space and extending in a rotational direction of said rotatable body, and said flat cable reversely turning halfway at said insertion section of said movable body so that its winding direction inside of said movably body is opposite to that outside thereof and movable to follow rotation of said rotatable body relative to the stationary body in forward and reverse directions, wherein at least one of said slide contact surface within said circular space and the sliding surface of said movable body coming into contact with said slide contact surface has a groove section having alternating grooves and flat portions extending in a circumferential direction to reduce sliding resistance to said movable body, said groove section being formed substantially over the whole of at least one of said slide contact surface and said sliding surface, accommodating a semi-fluid material adhered between said slide contact surface within said circular space and said sliding surface of said movable body, and being divided circumferentially into a plurality of segments.

* * * * *